US006805353B2

(12) United States Patent
Williams

(10) Patent No.: US 6,805,353 B2
(45) Date of Patent: Oct. 19, 2004

(54) METHOD OF PLAYING A CASINO CARD GAME

(76) Inventor: Robert W. Williams, 3138 W. Lincolnshire, Toledo, OH (US) 43606

( * ) Notice: Subject to any disclaimer, the term of this patent is extended or adjusted under 35 U.S.C. 154(b) by 0 days.

(21) Appl. No.: 10/401,996

(22) Filed: Mar. 28, 2003

(65) Prior Publication Data

US 2003/0184015 A1 Oct. 2, 2003

Related U.S. Application Data

(60) Provisional application No. 60/368,898, filed on Mar. 29, 2002.

(51) Int. Cl.[7] ..... A63F 1/00
(52) U.S. Cl. ..... 273/292; 273/274; 273/303
(58) Field of Search ..... 273/292, 274, 273/303

(56) References Cited

U.S. PATENT DOCUMENTS 6,371,484 B1 * 4/2002 Yuan ..... 273/292
6,402,148 B1 * 6/2002 Saruwatari ..... 273/292
6,406,020 B1 * 6/2002 Reed ..... 273/274
6,446,972 B1 * 9/2002 Brunelle ..... 273/292
6,471,210 B1 * 10/2002 Goldman et al. ..... 273/292
6,485,020 B1 * 11/2002 Broadnax ..... 273/292
6,508,470 B1 * 1/2003 Yuan ..... 273/292
6,543,773 B2 * 4/2003 Mims ..... 273/292
2004/0061288 A1 * 4/2004 Snow ..... 273/274
2004/0084843 A1 * 5/2004 Snow ..... 273/292
2004/0090005 A1 * 5/2004 Snow ..... 273/292

* cited by examiner

*Primary Examiner*—Derris H. Banks
*Assistant Examiner*—Dolores R. Collins
(74) *Attorney, Agent, or Firm*—MacMillan, Sobanski & Todd, LLC

(57) ABSTRACT

A contract wager and a bonus wager are placed to participate in the card game. A three card player hand is dealt face down to the player, a three card primary dealer hand is dealt face down to the dealer, and a three card dealer secondary hand is dealt face down to the dealer. Then, one of the cards of the primary dealer hand is exposed. The player hand is examined to determine the point total thereof, and an additional wager is placed to continue to participate in the card game. Then, the remaining two cards of the primary dealer hand are exposed, and the point total of the primary dealer hand is determined. If desired, one of the cards in the primary dealer hand may be replaced with one of the cards in the secondary dealer hand if the point total of the primary dealer hand is less than a predetermined minimum amount. Lastly, the contract wager and the additional wager are resolved by comparing the point total of the primary dealer hand to the point total of the player hand, and the bonus wager is resolved by comparing the point total of the player hand with a bonus pay table.

17 Claims, 5 Drawing Sheets

METHOD OF PLAYING A CASINO CARD GAME

CROSS REFERENCE TO RELATED APPLICATION

This application claims the benefit of U.S. Provisional Application No. 60/368,898, filed Mar. 29, 2002, the disclosure of which is incorporated herein by reference.

BACKGROUND OF THE INVENTION

This invention relates in general to casino card games. In particular, this invention relates to a casino card game that allows the casino to maintain a high house advantage while at the same time providing a fast-paced game that gives players the opportunity to wager and profit under a variety of scenarios that are dependent upon the outcome of the dealer's hand.

Casinos have become extremely popular entertainment alternatives and are becoming more readily available in a variety of locations, including many urban locations. In view of the growing number of available locations, casinos find themselves competing against one another for patrons. One method for casinos to attract patrons is to provide card games that are entertaining and offer the potential for winning large amounts of money in the form of bonus wagering options or jackpot wagering options. However, casinos must also choose games that provide a profitable return for the casino. In any given casino, particularly those casinos where the floor space is statutorily limited by gaming regulation or is physically limited (such as in a riverboat gambling environment), it is desirable that the games that are provided, including casino card games, generate a maximum amount of income for the casino.

There are a number of factors that affect the profitability of a casino game. One factor is the house advantage of a game, which is a measure of the amount of profit that the casino realizes by offering a particular game on its gambling floor. Another factor is the quantity of hands that can be played in a specified time period associated with the game, which is often referred to as the "action" of the game. In some jurisdictions, gaming regulations set maximums on the amounts of the house advantages of the casino games. As a result, casinos find it attractive to offer casino games that have a fast "action" to increase profitability.

In certain types of popular casino card games, such as Blackjack and variations thereof, players compete against a dealer. Casino card games of this type are relatively fast-paced, provide the opportunity for more that one person to win during each hand, and allow bets to be resolved quickly. However, it has been found to be somewhat difficult to modify such games to provide players with desirably high bonus or jackpot opportunities. Consequently, large pay-outs are generally not available in these types of casino card games. In other types of popular casino card games, such as Poker and variations thereof, players compete against one another. Casino card games of this type allow the opportunity for the players to generate large pay-outs. However, it has been found that such casino card games are relatively slow-paced. Variations of Poker, such as Caribbean Stud Poker and Pai Gow Poker, have been developed to incorporate play against the casino dealer, as well as to provide the opportunity for more that one person to win during each hand. However, these variations are generally based on complicated betting and ranking schemes that render such games undesirable for the inexperienced gambler. Thus, it would be desirable to provide an improved casino card game that allows the casino to maintain a high house advantage while at the same time providing a fast-paced game that gives players the opportunity to wager and profit under a variety of scenarios that are dependent upon the outcome of the dealer's hand.

SUMMARY OF THE INVENTION

This invention relates to an improved casino card game that allows the casino to maintain a high house advantage while at the same time providing a fast-paced game that gives players the opportunity to wager and profit under a variety of scenarios that are dependent upon the outcome of the dealer's hand. Initially, a contract wager and a bonus wager are placed to participate in the card game. A three card player hand is dealt face down to the player, a three card primary dealer hand is dealt face down to the dealer, and a three card dealer secondary hand is dealt face down to the dealer. Then, one of the cards of the primary dealer hand is exposed. The player hand is examined to determine the point total thereof, and an additional wager is placed to continue to participate in the card game. Then, the remaining two cards of the primary dealer hand are exposed, and the point total of the primary dealer hand is determined. If desired, one of the cards in the primary dealer hand may be replaced with one of the cards in the secondary dealer hand if the point total of the primary dealer hand is less than a predetermined minimum amount. Lastly, the contract wager and the additional wager are resolved by comparing the point total of the primary dealer hand to the point total of the player hand, and the bonus wager is resolved by comparing the point total of the player hand with a bonus pay table.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
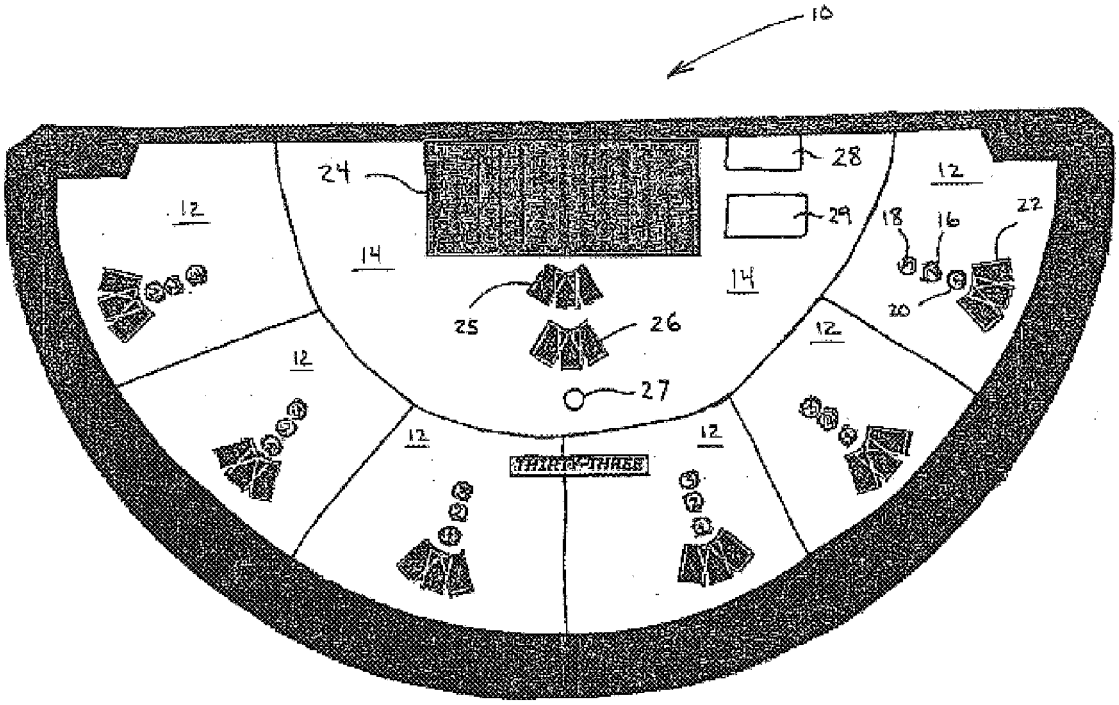
FIG. 1 is a top plan view of a gaming table that can be used to play a casino card game in accordance with this invention.

Referring now to the drawings, there is illustrated in FIG. 1 a gaming table, indicated generally at 10, that can be used to play a casino card game in accordance with this invention. The name of this gaming table 10 is identified as "Thirty-Three" in the illustrated embodiment, although such is not required. The gaming table 10 includes a plurality of individual player areas 12 and a dealer area 14. The illustrated gaming table 10 provides six individual player areas 12, which is the preferred number of player areas based upon the spatial limitations of the gaming table 10 and the relative comfort of the players. It will be appreciated, however, that the gaming table 10 may have any desired number of individual player areas 12. Each of the individual player areas 12 includes a contract wager betting area 16, a bonus wager betting area 18, a doubling wager betting area 20, and a player's hand area 22. The dealer's area 14 includes a chip rack 24 for holding gaming chips, an area for a primary dealer hand 25, an area for a secondary dealer hand 26, and a die cup 27. The die cup 27 contains a single die (not shown) therein having indicia provided thereon representing outcomes of either one, two, or three. The purpose for the die cup 27 and the die will be explained below. The dealer area 14 may also include a shuffling machine 28 from which cards may be dealt to the players and the dealer, a discard rack 29 for storing cards discarded from the players and the dealer, and a metered jackpot control area (not shown), which is used when a progressive jackpot is offered as the jackpot wager option for the casino card game.

The casino card game is played using at least one standard fifty-two card deck of playing cards. The preferred embodiment uses two standard decks of playing cards in an alternating arrangement. The alternating arrangement involves using a first deck of playing cards to deal the individual player hands 22 and the primary and secondary dealer hands 25 and 26. The dealer then uses a second deck of playing cards to perform any subsequent dealing, such as where the dealer does not initially meet her qualifying hand, as will be explained in greater detail below.

Figure 2A:
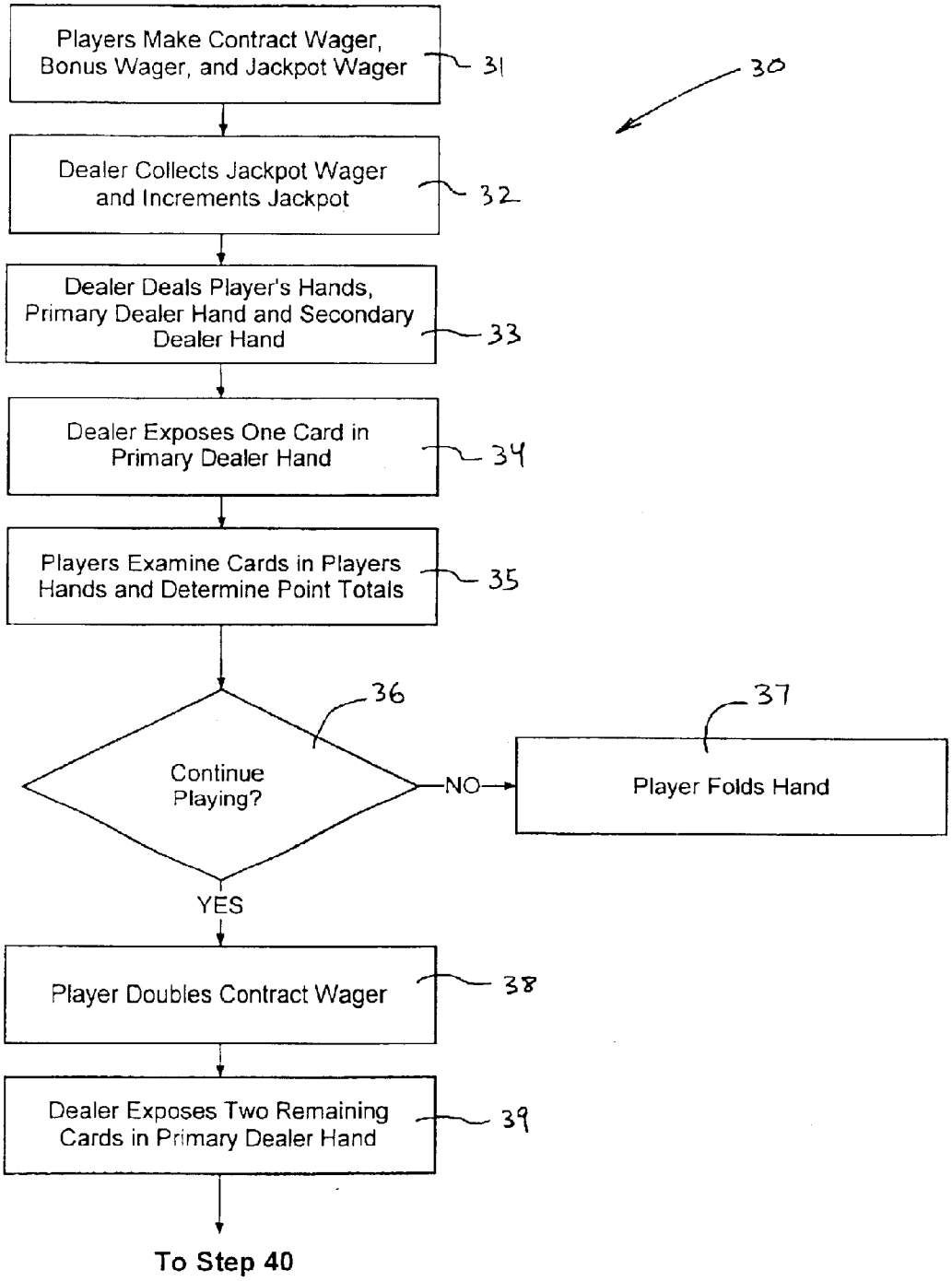
FIGS. 2A and 2B are first and second portions of a flow chart of a method for playing the basic casino card game of this invention.
Figure 2B:
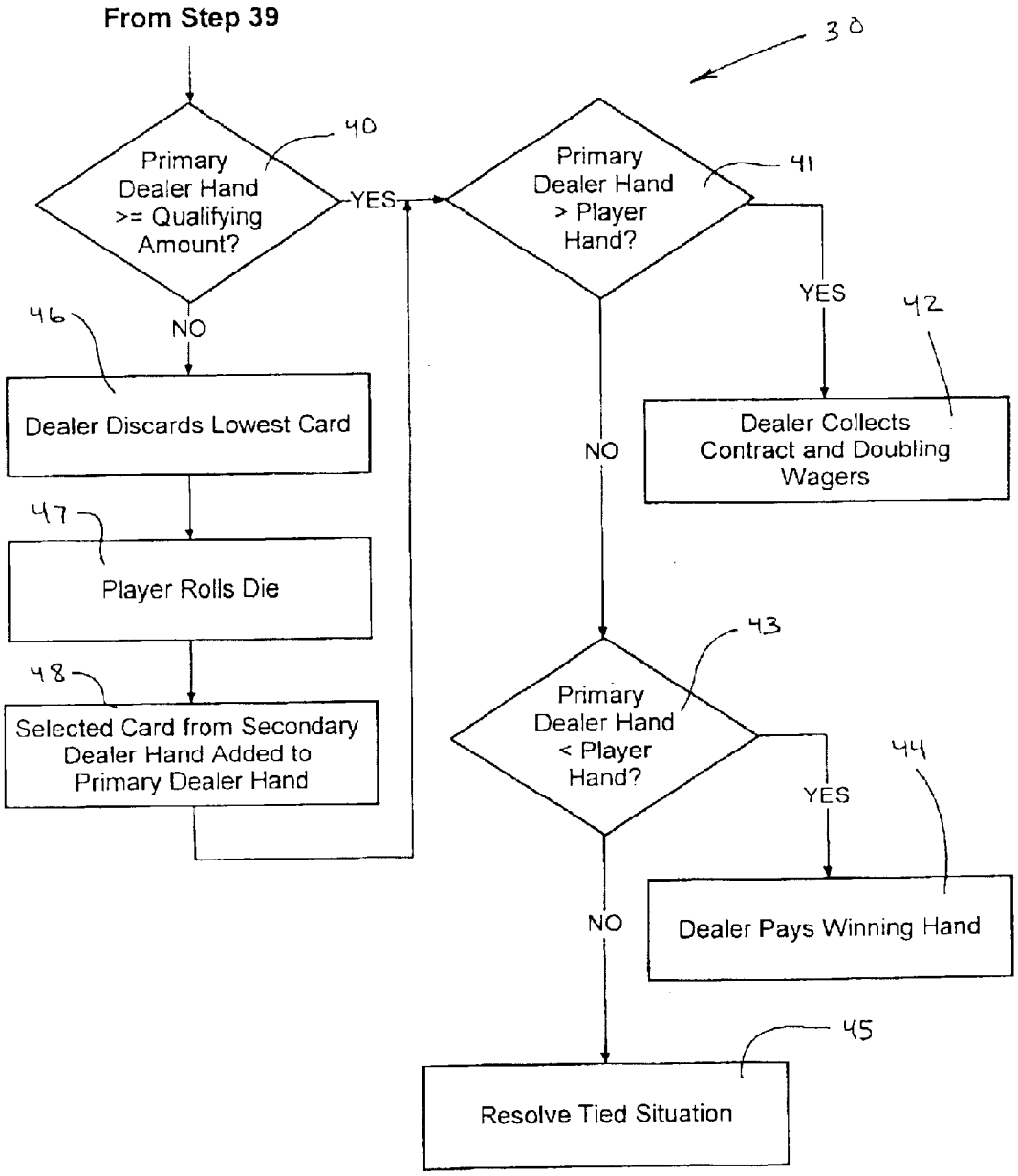

FIGS. 2A and 2*b* illustrated portions of a flow chart of the method, indicated generally at 30, for playing the basic casino card game of this invention. Prior to beginning the method 30, a dealer preferably shuffles at least one standard deck including fifty-two playing cards. This can be accomplished in any desired manner, such as by manual shuffling or using the automated shuffling machine 28 mentioned above. Following the shuffling of the playing cards, the method 30 of this invention begins with a first step 31, wherein the players make one or more opening bets in their respective playing areas 12 on the gaming table 10. In this first step 31, the players must make an initial wager, called the contract wager, by placing at least a minimum betting amount in the contract wager betting area 16 on the gaming table 10. At the same time, the players may elect to make either an additional bonus wager or an additional jackpot wager in the bonus wager betting area 18 on the gaming table 10. Preferably, the players may elect to place either the bonus wager or the jackpot wager, but not both. However, if desired, the players may be allowed to place both the bonus wager and the jackpot wager. If a bonus wager is made, the wager is left by the dealer in the bonus wager betting area 18 on the gaming table 10. If a jackpot wager is made, the wager may be removed from the gaming table 10 by the dealer, as shown in step 32 of the method, and deposited in a safe location. At the same time, the dealer may cause the jackpot to be incremented in a known manner to reflect that the jackpot wagers were collected. In a manner that is described in detail below, the bonus wager and the jackpot wager provide the players with additional opportunities to win. For the purpose of facilitating the explanation of the basic method 30 of this invention, however, the method 30 will initially be described in the context of the basic operation of the casino card game, wherein no bonus wager or jackpot wager has been made in the first step 31.

In a third step 33 of the method 30, the dealer begins play by dealing the three card player hand 22 in each of the individual player areas 12 for which a contract bet has been made by a player. Each of the three card player hands 22 is dealt face down. The dealer also deals the three card primary dealer hand 25 and the three card secondary dealer hand 26. Both the primary dealer hand 25 and the secondary dealer hand 26 are also dealt face down. The dealing of the playing cards can be accomplished in any desired manner. For example, the dealer may initially deal all of the player hands 22, followed by dealing the primary dealer hand 25 and the secondary dealer hand 26. Alternatively, the dealer may simultaneously deal all of the player hands 22, the primary dealer hand 25, and the secondary dealer hand 26. Following the dealing procedure, the dealer may, if desired, place the die cup 27 containing the die on top of the secondary dealer hand 26 to clearly distinguish the secondary dealer hand 26 from the primary dealer hand 25.

Next, in a fourth step 34 of the method 30, the dealer exposes one of the three playing cards in the primary dealer hand 25 for all of the players to see. The decision as to which of the three playing cards in the primary dealer hand 25 is selected to be exposed may be left to the discretion of the dealer or can be determined using any desired method (always the middle playing card, for example). In any event, only one of the three playing cards in the primary dealer hand 25 is exposed for all of the players to see, while the remaining two playing cards in the primary dealer hand 25 remain concealed. In a fifth step 35 of the method 30, the players examine the playing cards in their respective players hands 22 and calculate the point totals thereof. The point total of each of the players hands 22 is equal the sum of the point values of the individual playing cards contained in that hand. The point values of the playing cards can be determined as follows: (1) for numbered cards, the point value equal the value of the number thereon; (2) for face cards, the point value equals ten; and (3) for aces, the point value equals eleven. Using these point values, the lowest point total for a hand would be six (if the hand consists of three twos), and the highest point total for a hand would be thirty-three (if the hand consists of three aces).

The method 30 next enters a decision point 36, wherein each of the players determines whether it is advisable to continue playing the casino card game. This determination is made by each of the players based upon their individual decision as to whether they are likely to win, lose, or draw the hand with the dealer. If the calculated point total of the individual player hand 22 is greater than the calculated point total of the primary dealer hand 25, then the player will win the hand and will receive not only the original contract wager, but also a winning pay-out. If the calculated point total of the individual player hand 22 is less than the calculated point total of the primary dealer hand 25, then the player will lose the hand and will lose the original contract wager. Lastly, if the calculated point total of the individual player hand 22 is equal to the calculated point total of the primary dealer hand 25, then the player will draw the hand with the dealer and will receive only the original contract wager. However, because only one of the three playing cards in the primary dealer hand 25 is exposed for the player to see (while the remaining two playing cards in the primary dealer hand 25 remain concealed), the player must accept an element of risk in making this decision.

If the player elects to not continue playing the casino card game, the method branches to a step 37, wherein the player folds the hand by returning the playing cards to the dealer. At that time, the dealer collects the contract wager from the player, and the hand is completed for that individual player. If, on the other hand, the player elects to continue playing the casino card game, the method branches to a step 38, wherein the player supplements the previously made contract wager by placing an additional wager in the doubling wager betting area 20 on the gaming table 10. Preferably, the additional wager will be the same amount as the contract wager and, thus, will be referred to herein as the double wager. After each player has either folded or elected to continue play in this manner, the method enters a step 39 wherein the dealer exposes the two remaining playing cards in the primary dealer hand 25 and determines the point total thereof. In order to insure that the method 30 of this invention provides an adequate profit advantage for the casino, it is desirable that the point total of the primary dealer hand 25 be greater than a predetermined minimum point total. Thus, the method 30 enters a decision point 40, wherein it is determined whether the point total of the primary dealer hand 25 is greater than or equal a predetermined minimum point total, referred to as a qualifying hand. In the illustrated embodiment, the predetermined minimum point total for a qualifying primary dealer hand 25 is twenty-two. However, the predetermined minimum point total for the qualifying primary dealer hand 25 may be set at any desired value.

If the point total for the primary dealer hand 25 is greater than or equal to the predetermined minimum point total, then the method 30 branches from the decision point 40 to a decision point 41, wherein it is determined whether the point total of the primary dealer hand 25 is greater than the point total of the player hand 22. If the point total of the primary dealer hand 25 is greater than the point total of the player hand 22, then the dealer wins the hand. Thus, the method 30 branches from the decision point 41 to a step 42, wherein the dealer collects both the contract wager and the double wager from the player, and the hand is ended for that player. If, on the other hand the point total of the primary dealer hand 25 is greater than the point total of the player hand 22, then the method branches from the decision point 41 to a decision point 43, wherein it is determined whether the point total of the primary dealer hand 25 is less than the point total of the player hand 22. If the point total of the primary dealer hand 25 is less than the point total of the player hand 22, then the player wins the hand. Thus, the method branches from the decision point 43 to a step 44, wherein the dealer returns both the contract wager and the double wager to the player, along with a winning amount, which is typically equal to the combined amount of both the contract wager and the double wager, and the hand is ended for that player. If the point total of the primary dealer hand 25 is neither greater than nor less than the point total of the player hand 22, then the point total of the primary dealer hand 25 is equal to the point total of the player hand 22. Thus, the method branches from the decision point 43 to a step 45, wherein the tied situation is resolved. A tied situation such as this can be resolved in any desired manner. Typically, the tied situation is resolved by having the dealer return both the contract wager and the double wager to the player, thus ending the hand for that player. Alternatively, the tied situation is resolved by allowing either the dealer or the player to win the hand, as described above. Furthermore, a tied situation may be resolved by a combination of these techniques, such as by having the dealer return both the contract wager and the double wager to the player except when the tie occurs on a specific number (twenty-two, for example), in which case the dealer wins the hand.

Referring back to the decision point 40, if the point total for the primary dealer hand 25 is less than the predetermined minimum point total, then the dealer is provided with an opportunity to replace one of the playing cards in the primary dealer hand 25 with one of the playing cards in the secondary dealer hand 26. In the preferred embodiment of the invention, the selection of the playing card in the primary dealer hand 25 is made by selecting the playing card therein having the lowest point value. Thus, the method 30 branches from the decision point 40 to a step 46, wherein the dealer discards the playing card in the primary dealer hand 25 having the lowest point total and places it in the discard rack 29. In the preferred embodiment of the invention, the selection of the playing card in the secondary dealer hand 26 to replace the playing card discarded from the primary dealer hand 25 is made by a random event. To accomplish this, the dealer can use the die contained in the die cup 27 discussed above. The dealer initially removes the die cup 27 containing the die from its location on the gaming table 10 and offers it to one of the players. The die cup 27 may be offered to the players in any desired manner. For example, the dealer may initially offer the die cup 27 to the player on a predetermined side or end of the gaming table 10. If that player declines the opportunity to roll the die, then the dealer may offer the die cup 27 sequentially around the gaming table 10 to the other players. If all of the players decline to roll the die, then the dealer may roll the die. Regardless, the die contained in the die cup 27 is rolled on the gaming table, as shown in step 47 of the method 30.

As discussed above, the die cup 27 contains a single die (not shown) therein having indicia provided thereon representing outcomes of either one, two, or three. For example, the die may be a conventional six-sided cube having indicia provided thereon representing outcomes of one on two of the sides, two on two of the sides, and three on two of the sides. When the die is rolled from the die cup 27, the outcome thereof determines which one of the first, second, or third playing cards in the secondary dealer hand 26 (which, up to this point in the method 30 of this invention, have remained face down and, therefore, unexposed on the gaming table 10) will be selected to replace the playing card that the dealer just discarded from the primary dealer hand 25, as shown in step 48 of the method 30. Thus, if the outcome of the roll of the die is a one, then the first of the three playing cards in the secondary dealer hand 26 will be selected to replace the playing card that the dealer just discarded from the primary dealer hand 25. The three playing cards in the secondary dealer hand 26 can be designated as the first, second, and third playing cards in any desired manner. After the designated one of the three playing cards in the secondary dealer hand 26 is added to the primary dealer hand 25, the remaining two playing cards in the secondary dealer hand 26 are discarded in the discard rack 29. The method 30 then enters the decision point 41 and continues as described above to complete the hand.

From the above description of the method 30 of this invention, it can be seen that the various outcomes of the basic casino card game are determined by comparing the point totals of the players hands 22 with the point totals of the primary dealer hand 25 (either with or without a supplemental playing card provided from the secondary dealer hand 26). However, as discussed above, in the first step 31 of the method 30 of this invention, the players may make not only the contract wager, but also have an opportunity to place either an additional bonus wager or an additional jackpot wager in the bonus wager betting area 18 on the gaming table 10. In the preferred embodiments of this invention, the outcomes of the bonus wager and the jackpot wager are determined not by comparing the point totals of the players hands 22 with the point totals of the primary dealer hand 25, but by comparing the point totals of the players hands 22 with a predetermined standard of reference, such as a bonus pay table or a jackpot pay table.

Figure 3:
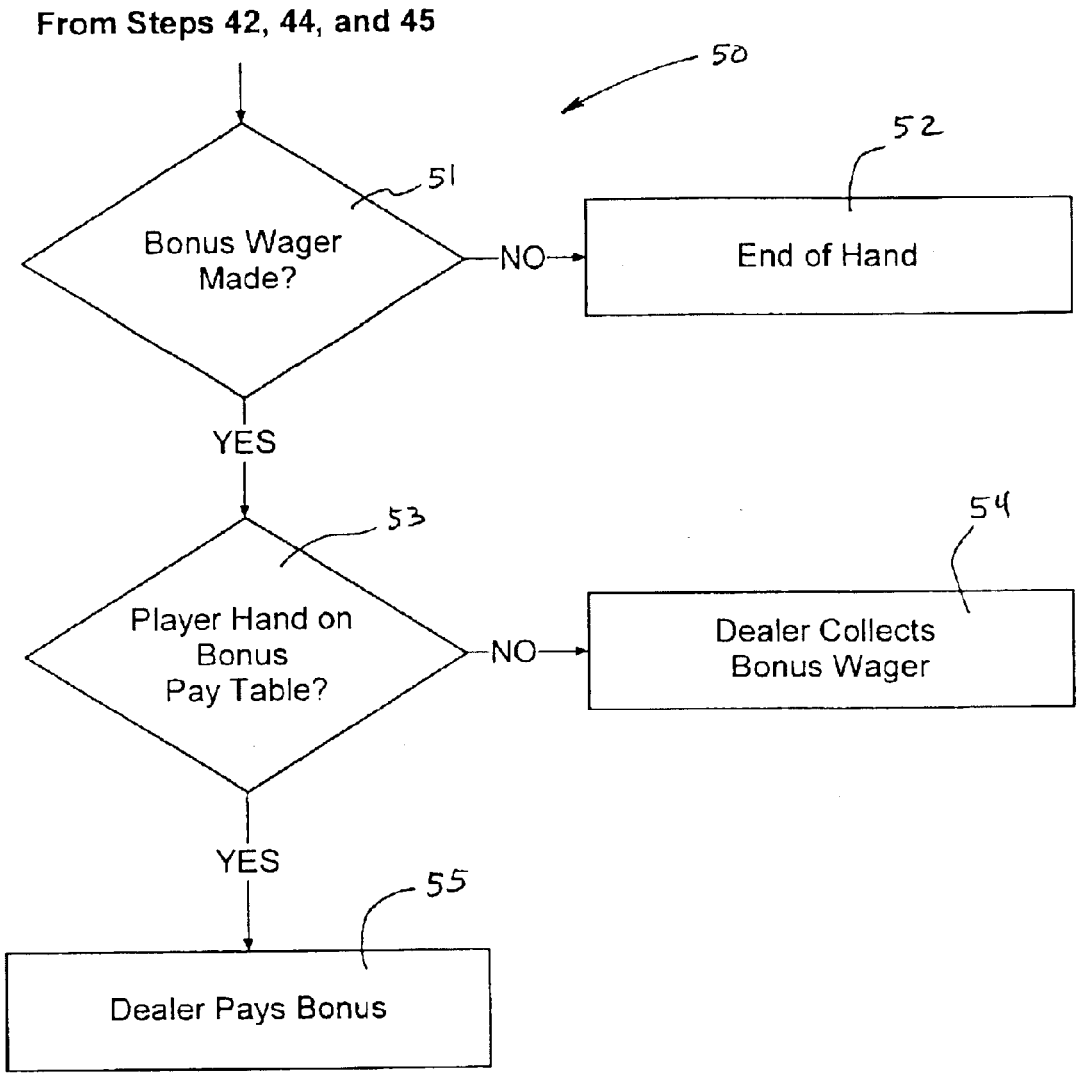
FIG. 3 is a flow chart of a first modified method for playing the casino card game according to the method illustrated in FIGS. 2A and 2B when a bonus wager is made.

FIG. 3 is a flow chart of a first modified method, indicated generally at 50, for playing the casino card game according to the method 30 illustrated in FIGS. 2A and 2B when a bonus wager is made in step 31. The bonus wager can be resolved after the basic casino card game has been completed, as described above. Thus, the method 30 branches from either the step 42, the step 44, or the step 45 (depending upon the particular outcome that was achieved) to a decision point 51, wherein it is determined whether such a bonus wager was made. If no bonus wager was made, then the hand is completed as described above. However, is a bonus wager was made, then the modified method 50 branches to a decision point 52, wherein it is determined whether the point total in the players hand 22 is listed on a bonus pay table. If the point total in the players hand 22 is not listed on the bonus pay table, then the player loses the bonus wager. Thus, the modified method 50 enters a step 54, wherein the dealer collects the bonus wager from the player. If, on the other hand, the point total in the players hand 22 is listed on the bonus pay table, then the player wins the bonus wager. Thus, the modified method 50 enters a step 55, wherein the dealer pays the player a bonus amount that is set forth in the bonus pay table.

Table 1 below illustrates several examples of bonus pay tables that can be used when a player makes an additional bonus wager in the first step 31 of the method 30 of this invention.

TABLE 1

BONUS PAY TABLES

| Player Hand Point Total | Probability Of Occurrence | Pay Table A Pay-Out Odds | Pay Table B Pay-Out Odds | Pay Table C Pay-Out Odds |
|---|---|---|---|---|
| 6 | 0.0181% | 100:1 | 50:1 | 50:1 |
| 26 | 5.7195% | — | 2:1 | 2:1 |
| 27 | 5.0136% | 2:1 | 2:1 | 2:1 |
| 28 | 4.1628% | 3:1 | 2:1 | 2:1 |
| 29 | 3.5475% | 3:1 | 2:1 | 3:1 |
| 30 | 3.8009% | 3:1 | 3:1 | 3:1 |
| 31 | 2.2605% | 4:1 | 5:1 | 5:1 |
| 32 | 0.4344% | 15:1 | 10:1 | 10:1 |
| 33 | 0.0181% | 250:1 | 200:1 | 100:1 |

Table 1, it is assumed that there are nine different bonus point totals that a given players hand 22 can achieve (namely, six and twenty-six through thirty-three) for which a bonus pay-out will be made, provided that a bonus wager was made at the first step 31 of the method 30. The approximate probabilities of occurrence for each of such point totals are also set forth in Table 1. For example, the approximate probability of occurrence of a player hand 22 having a point total of six is 0.0181%, while the approximate probability of occurrence of a player hand 22 having a point total of twenty-seven is 3.8009%.

Table 1 illustrates three sample pay tables (identified as Pay Table A, Pay Table B, and Pay Table C) that can be used to determine the amounts of the bonus pay-outs that will be made if one of the nine bonus point totals is achieved in a players hand 22. For example, if Pay Table A is used and a player hand 22 has a point total of six, then the bonus wager that was made at the first step 31 of the method 30 will result in a bonus pay-out of one hundred times the amount of the bonus wager, while if a player hand 22 has a point total of twenty-seven, then the bonus wager that was made at the first step 31 of the method 30 will result in a bonus pay-out of three times the amount of the bonus wager. If Pay Table B is used and a player hand 22 has a point total of six, then the bonus wager that was made at the first step 31 of the method 30 will result in a bonus pay-out of fifty times the amount of the bonus wager, while if a player hand 22 has a point total of twenty-seven, then the bonus wager that was made at the first step 31 of the method 30 will result in a bonus pay-out of two times the amount of the bonus wager. It should be noted that in Pay Table A, a player hand 22 having a point total of twenty-six will not pay-out a bonus. The pay-out odds that are set forth in the various bonus pay tables can be adjusted as desired.

Figure 4:
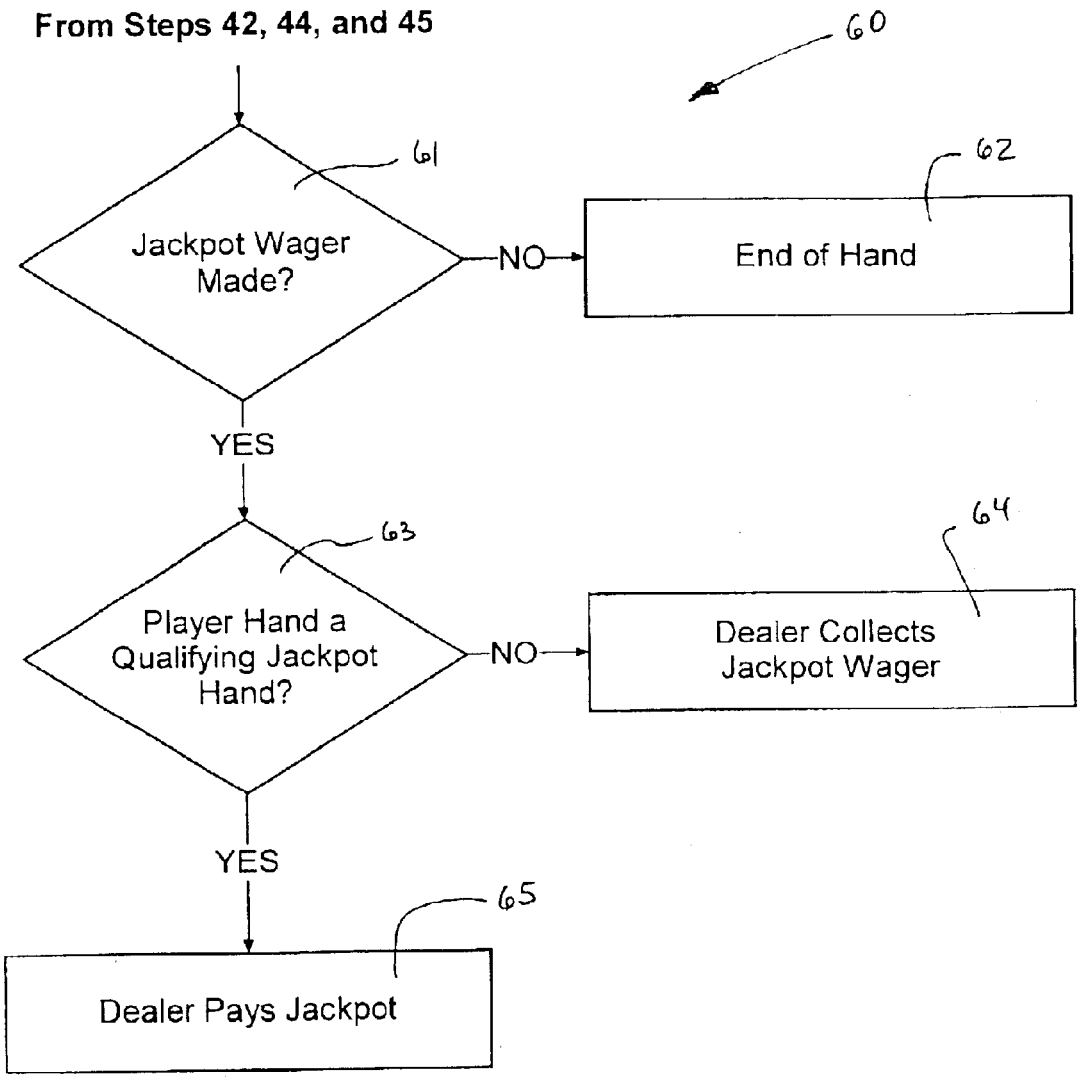
FIG. 4 is a flow chart of a second modified method for playing the casino card game according to the method illustrated in FIGS. 2A and 2B when a jackpot wager is made.

FIG. 4 is a flow chart of a second modified method, indicated generally at 60, for playing the casino card game according to the method 30 illustrated in FIGS. 2A and 2B when a jackpot wager is made in step 31. The jackpot wager can also be resolved after the basic casino card game has been completed, as described above. Thus, the method 30 branches from either the step 42, the step 44, or the step 45 (depending upon the particular outcome that was achieved) to a decision point 61, wherein it is determined whether such a jackpot wager was made. If no jackpot wager was made, then the hand is completed as described above. However, is a jackpot wager was made, then the modified method 60 branches to a decision point 62, wherein it is determined whether the point total in the players hand 22 is a qualifying jackpot hand. A qualifying jackpot hand is defined as a point total for which a jackpot will be paid. Typically, the qualifying jackpot hands are point totals that have the lowest probability of occurrence, such as six and thirty-three. However, the qualifying jackpot hands can be defined in any desired manner. If the point total in the players hand 22 is not a qualifying jackpot hand, then the player loses the jackpot wager. Thus, the modified method 60 enters a step 64, wherein the dealer collects the jackpot wager from the player. If, on the other hand, the point total in the players hand 22 is a qualifying jackpot hand, then the player wins the jackpot. Thus, the modified method 60 enters a step 65, wherein the dealer pay the player the jackpot. The jackpot can be a fixed amount, or it can be a progressive amount that accumulates in size in any desired manner, such as a conventional progressive jackpot that is accumulated from a plurality of different gaming tables 10 as is well known in the art.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of playing a card game between a player and a dealer using at least one standard deck of playing cards comprising the steps of:

(a) placing a contract wager to participate in the card game;

(b) dealing a three card player hand face down to the player and a three card primary dealer hand face down to the dealer;

(c) exposing one of the cards of the primary dealer hand;

(d) examining the player hand to determine the point total thereof;

(e) placing an additional wager to continue to participate in the card game;

(f) exposing the remaining two cards of the primary dealer hand;

(g) determining the point total of the primary dealer hand; and (h) resolving the contract wager and the additional wager by comparing the point total of the primary dealer hand to the point total of the player hand.

2. The method defined in claim 1 wherein said step (h) is performed by (1) resolving the contract wager and the additional wager in favor of the player when the point total of the primary dealer hand is less than the point total of the player hand, (2) resolving the contract and the additional wager in favor of the dealer when the point total of the primary dealer hand is greater than the point total of the player hand, and (3) resolving the contract wager and the additional wager as a tie when the point total of the primary dealer hand is equal to the point total of the player hand.

3. A method of playing a card game between a player and a dealer using at least one standard deck of playing cards comprising the steps of:

(a) placing a contract wager to participate in the card game;

(b) dealing a three card player hand face down to the player, a three card primary dealer hand face down to the dealer, and a three card dealer secondary hand face down to the dealer;

(c) exposing one of the cards of the primary dealer hand;

(d) examining the player hand to determine the point total thereof;

(e) placing an additional wager to continue to participate in the card game;

(f) exposing the remaining two cards of the primary dealer hand;

(g) determining the point total of the primary dealer hand;

(h) replacing one of the cards in the primary dealer hand with one of the cards in the secondary dealer hand if the point total of the primary dealer hand is less than a predetermined minimum amount; and (i) resolving the contract wager and the additional wager by comparing the point total of the primary dealer hand to the point total of the player hand.

4. The method defined in claim 3 wherein said step (h) is performed by replacing the card having the lowest point value in the primary dealer hand with one of the cards in the secondary dealer hand.

5. The method defined in claim 3 wherein said step (h) is performed by randomly selecting one of the cards in the secondary dealer hand and using the randomly selected card to replace one of the cards in the primary dealer hand.

6. The method defined in claim 5 wherein said step (h) is performed by designating the cards in the secondary dealer hand as first, second, and third playing cards, rolling a die having indicia provided thereon representing outcomes of either the first, second, or third playing cards, and selecting the first, second, or third playing card in the secondary dealer hand in accordance with the outcome of the roll of the die.

7. The method defined in claim 3 wherein said step (h) is performed by (1) resolving the contract wager and the additional wager in favor of the player when the point total of the primary dealer hand is less than the point total of the player hand, (2) resolving the contract wager and the additional wager in favor of the dealer when the point total of the primary dealer hand is greater than the point total of the player hand, and (3) resolving the contract wager and the additional wager as a tie when the point total of the primary dealer hand is equal to the point total of the player hand.

8. A method of playing a card game between a player and a dealer using at least one standard deck of playing cards comprising the steps of:

(a) placing a contract wager and a bonus wager to participate in the card game;

(b) dealing a three card player hand face down to the player, a three card primary dealer hand face down to the dealer, and a three card dealer secondary hand face down to the dealer;

(c) exposing one of the cards of the primary dealer hand;

(d) examining the player hand to determine the point total thereof;

(e) placing an additional wager to continue to participate in the card game;

(f) exposing the remaining two cards of the primary dealer hand;

(g) determining the point total of the primary dealer hand;

(h) replacing one of the cards in the primary dealer hand with one of the cards in the secondary dealer hand if the point total of the primary dealer hand is less than a predetermined minimum amount;

(i) resolving the contract wager and the additional wager by comparing the point total of the primary dealer hand to the point total of the player hand; and (j) resolving the bonus wager by comparing the point total of the player hand with a bonus pay table.

9. The method defined in claim 8 wherein said step (h) is performed by replacing the card having the lowest point value in the primary dealer hand with one of the cards in the secondary dealer hand.

10. The method defined in claim 8 wherein said step (b) is performed by randomly selecting one of the cards in the secondary dealer hand and using the randomly selected card to replace one of the cards in the primary dealer hand.

11. The method defined in claim 10 wherein said step (h) is performed by designating the cards in the secondary dealer hand as first, second, and third playing cards, rolling a die having indicia provided thereon representing outcomes of either the first, second, or third playing cards, and selecting the first, second, or third playing card in the secondary dealer hand in accordance with the outcome of the roll of the die.

12. The method defined in claim 8 wherein said step (h) is performed by (1) resolving the contract wager and the additional wager in favor of the player when the point total of the primary dealer hand is less than the point total of the player hand, (2) resolving the contract wager and the additional wager in favor of the dealer when the point total of the primary dealer hand is greater than the point total of the player hand, and (3) resolving the contract wager and the additional wager as a tie when the point total of the primary dealer hand is equal to the point total of the player hand.

13. The method defined in claim 8 wherein said step (i) is performed by comparing the point total of the player hand with a predetermined standard of reference.

14. The method defined in claim 13 wherein said step (i) is performed by comparing the point total of the player hand with a predetermined standard of reference.

15. The method defined in claim 13 wherein said step (i) is performed by comparing the point total of the player hand with a bonus pay table that correlates predetermined point totals of the player hand with predetermined pay-out odds.

16. The method defined in claim 8 wherein said step (a) is performed by placing a jackpot wager in lieu of the bonus wager, and wherein said step (i) is performed resolving the jackpot wager by determining whether the point total in the players hand is a qualifying jackpot hand.

17. The method defined in claim 8 wherein said step (a) is performed by placing a jackpot wager in addition to the bonus wager, and wherein said step (i) is performed resolving the jackpot wager by determining whether the point total in the players hand is a qualifying jackpot hand.

* * * * *

UNITED STATES PATENT AND TRADEMARK OFFICE

CERTIFICATE OF CORRECTION

PATENT NO. : 6,805,353 B2
DATED : October 19, 2004
INVENTOR(S) : Robert W. Williams It is certified that error appears in the above-identified patent and that said Letters Patent is hereby corrected as shown below:

Column 10,
Line 24, "step (b)" should be -- step (h) --.

Signed and Sealed this

First Day of February, 2005

JON W. DUDAS
*Director of the United States Patent and Trademark Office*